US011391128B1

(12) United States Patent
Jiang et al.

(10) Patent No.: US 11,391,128 B1
(45) Date of Patent: Jul. 19, 2022

(54) METHOD FOR PRODUCING HEAVY OIL BY GENERATING SOLVENTS IN SITU IN THE RESERVOIR

(71) Applicant: Southwest Petroleum University, Chengdu (CN)

(72) Inventors: Qi Jiang, Chengdu (CN); Jiali Liu, Chengdu (CN); Fangjie Wu, Chengdu (CN); Siyuan Huang, Chengdu (CN); Chunsheng Yu, Chengdu (CN); Xiang Zhou, Chengdu (CN); Zhibin Wang, Chengdu (CN); Yang Zhang, Chengdu (CN); Ke Huang, Chengdu (CN); Jie He, Chengdu (CN)

(73) Assignee: Southwest Petroleum University, Chengdu (CN)

( * ) Notice: Subject to any disclaimer, the term of this patent is extended or adjusted under 35 U.S.C. 154(b) by 0 days.

(21) Appl. No.: 17/536,130

(22) Filed: Nov. 29, 2021

(30) Foreign Application Priority Data

Dec. 31, 2020 (CN) ..... 202011618975.2

(51) Int. Cl.
*E21B 43/12* (2006.01)
*E21B 47/06* (2012.01)
(Continued)

(52) U.S. Cl.
CPC ..... *E21B 43/121* (2013.01); *E21B 36/04* (2013.01); *E21B 43/24* (2013.01); *E21B 47/06* (2013.01)

(58) Field of Classification Search
CPC ..... E21B 43/121; E21B 36/04; E21B 43/24; E21B 47/06
See application file for complete search history.

(56) References Cited

U.S. PATENT DOCUMENTS 6,016,867 A * 1/2000 Gregoli ..... E21B 43/243 166/267
7,980,312 B1 * 7/2011 Hill ..... E21B 43/241 166/272.2
(Continued)

FOREIGN PATENT DOCUMENTS

CN 102635342 A 8/2012
CN 103375156 A 10/2013
(Continued)

OTHER PUBLICATIONS

Muraza, "Aquathermolysis of heavy oil: A review and perspective on catalyst development", Fuel 157 (2015) 219-231 (Year: 2015).*
(Continued)

*Primary Examiner* — Steven A MacDonald

(57) ABSTRACT

The disclosure relates to a method for producing heavy oil by generating solvents in situ in the reservoir, an electric heating device is used to heat up the crude oil in the reservoir near the wellbore to the target temperature. Chemical reaction additives are injected into the heating section to meet the preset reaction conditions for the high temperature thermal cracking and aquathermolysis of crude oil, so as to generate light hydrocarbon components and gases. Under the effect of heat and gravity, the light hydrocarbon components and gases rise to the steam chamber. The light hydrocarbons and some gases that move to the vapor-liquid interface of the steam chamber are dissolved in the crude oil to reduce the viscosity of crude oil and increase the production rate of crude oil.

12 Claims, 6 Drawing Sheets

(51) Int. Cl.

| | |
|---|---|
| ***E21B 43/24*** | (2006.01) |
| ***E21B 36/04*** | (2006.01) |

(56) References Cited

U.S. PATENT DOCUMENTS

| | | | | |
|---|---|---|---|---|
| 9,739,125 | B2 * | 8/2017 | Benson | E21B 43/2406 |
| 10,125,587 | B1 * | 11/2018 | Lockhart | E21B 17/1035 |
| 10,920,545 | B2 * | 2/2021 | Wheeler | E21B 43/121 |
| 2005/0051327 | A1 * | 3/2005 | Vinegar | E21B 47/00 166/57 |
| 2006/0283598 | A1 * | 12/2006 | Kasevich | E21B 43/2401 166/57 |
| 2007/0199706 | A1 * | 8/2007 | Hocking | E21B 43/2405 166/57 |
| 2007/0199707 | A1 * | 8/2007 | Hocking | E21B 43/267 166/57 |
| 2009/0071652 | A1 * | 3/2009 | Vinegar | C09K 8/845 166/303 |
| 2010/0089586 | A1 * | 4/2010 | Stanecki | E21B 44/02 166/302 |
| 2010/0258309 | A1 * | 10/2010 | Ayodele | E21B 43/243 166/272.3 |
| 2011/0146982 | A1 * | 6/2011 | Kaminsky | E21B 43/247 166/272.2 |
| 2012/0048544 | A1 * | 3/2012 | Kaminsky | E21B 43/24 166/272.1 |
| 2012/0048545 | A1 * | 3/2012 | Kaminsky | E21B 43/2401 166/272.1 |
| 2012/0325458 | A1 * | 12/2012 | El-Rabaa | C09K 8/80 166/248 |
| 2017/0089187 | A1 * | 3/2017 | Hytken | E21B 36/005 |
| 2021/0047905 | A1 * | 2/2021 | Strem | E21B 43/243 |

FOREIGN PATENT DOCUMENTS

| | | | |
|---|---|---|---|
| CN | 103615199 | A | 3/2014 |
| CN | 104563981 | A | 4/2015 |
| CN | 106996283 | A | 8/2017 |
| CN | 108952653 | A | 12/2018 |
| CN | 111322045 | A | 6/2020 |
| CN | 111520118 | A | 8/2020 |

OTHER PUBLICATIONS

Name of the author: Qi jiang title of the article: Determining CO2 diffusion coefficient in heavy oil in bulk phase and in porous media using experimental and mathematical modeling methods title of the item: <<fuel>> date: Mar. 31, 2020.

Name of the author: Peiyuan LI title of the article: Research progress of heavy oil visbreaking thermal cracking process title of the item: <<Chemistry and bonding>> date: Mar. 31, 2015.

Name of the author: Qi jiang title of the article: Preliminary discussion on the status quo and development direction of heavy oil production technology title of the item: <<Special oil and gas reservoir>> date: Dec. 17, 2020.

Name of the author: Xuezhong Wang title of the article: Research on the Assumption of Mining and Production of Shallow Super Heavy Oil and Its Supporting Technology title of the item: <<Technology and Industry>> date: Nov. 30, 2020.

* cited by examiner

METHOD FOR PRODUCING HEAVY OIL BY GENERATING SOLVENTS IN SITU IN THE RESERVOIR

CROSS-REFERENCE TO RELATED APPLICATIONS

The application claims priority to Chinese patent application No. 202011618975. 2, filed on Dec. 31, 2020, the entire contents of which are incorporated herein by reference.

TECHNICAL FIELD

The present disclosure pertains to the field of oilfield development and relates to a method for producing heavy oil, in particular to a method for producing heavy oil by generating solvents in situ in the reservoir.

BACKGROUND

In China, the reserves of heavy oil have exceeded $200\times10^8$ t, which are distributed in more than 70 oilfields in 12 sedimentary basins. At present, the producing geological reserves for commercial development are about $14\times10^8$ t. As the crude oil viscosity of most heavy oil reservoirs in China is higher than 10,000 mPa·s, the thermal production through steam injection is the main method. Steam huff and puff is still the main method for heavy oil production in China, but most oilfields have entered the final stage of production. The steam efficiency is low, and the final recovery factor is generally less than 30%. The recovery factor by steam flooding and SAGD technology is quite high (more than 50%), but only in the high quality reservoirs and with high steam consumption. After steam injection, a large amount of remaining oil is left over in the reservoir and usually cannot be produced economically.

To improve the thermal efficiency of steam based thermal recovery processes, a lot of research and field tests have been carried out in recent years with co-injection of solvent and non-condensable and steam. The main benefit of adding non-condensable gas is to reduce the temperature at the top of the steam chamber, reducing the heat loss and improving the oil-steam ratio. A large number of laboratory experiments have shown that the method of adding non-condensable gas into steam can reduce the amount of steam requirement for SAGD production process. Field tests carried out by several domestic and international oil companies show that the addition of non-condensable gas can not only improve the steam efficiency, but also facilitate the expansion of the steam chamber in the low permeability area, and reduce the influence of reservoir heterogeneity on the development rate of steam chamber. However, when the content of non-condensable gas in the steam chamber is too high, the production of the oil well could be reduced.

Laboratory studies and field tests show that adding solvent in the process of steam huff and puff and SAGD is beneficial to increase the crude oil production rate. The added solvent is mainly the light hydrocarbons ($C_4$-$C_{10}$), which is injected with the steam or intermittently injected with the steam. Representative technologies include LASER-Liquid Addition to Steam Enhanced Recovery, ES-SAGD (Expanding Solvent-SAGD), and SAP (Solvent Aided Process), etc. Cenovus conducted the field tests of adding light hydrocarbon (solvent) into steam in the SAGD project of Christina Lake Oilfield. The results show that after adding light hydrocarbon ($C_4$-$C_{10}$) into the steam, the oil production and oil-steam ratio increased by more than 50%, and the API° and viscosity of crude oil decreased. Therefore, the addition of solvent can not only improve the production of crude oil and thermal efficiency of steam, but also improve the properties of crude oil.

Although the production of heavy oil through solvent assisted steam injection has high efficiency, the high cost of solvent, coupled with the low recovery ratio of solvent from the formation (less than 70%), resulting in high operating cost and even uneconomic production of heavy oil by solvent-assisted steam injection. In order to overcome this technical difficulty, the present disclosure discloses a method for producing heavy oil through solvents generated in situ in the reservoir. The heat (steam), solvent (light component of crude oil) and non-condensable gas necessary for producing heavy oil are generated in the reservoir by taking the controlled high temperature aquathermolysis reaction method to reduce the $CO_2$ emissions and operating cost. This method can be applied not only in the middle and late stages of SAGD, but also in the other types of heavy oil production, such as follow-up recovery technologies in the later period of steam huff and puff as well as production of low-grade heavy oil reservoirs.

SUMMARY

The purpose of the present disclosure is to provide a method for producing heavy oil through solvents generated in situ in the reservoir. There is no need to produce steam from the ground and add the solvent, but the solvents generated in situ in the reservoir are utilized to produce heavy oil, so as to improve the heat utilization efficiency, reduce the emissions of $CO_2$, improve the final recovery factor. This method provides the technical solution in reservoirs where the oil rate and the oil-steam ratio are low such as in the middle and later stages of SAGD operations, with broad application potential in other types of thermal recovery processes.

In order to realize the above technical purpose, the present disclosure adopts the following technical scheme.

In the present disclosure, an electric heating device is used to heat up the crude oil in the reservoir near the wellbore to the target temperature. Chemical reaction additives are injected into the heating section to meet the preset reaction conditions for the high temperature aquathermolysis of crude oil, so as to generate light hydrocarbon components and gases. Under the effect of heat and gravity, the light hydrocarbon components and gases rise to the steam chamber. The light hydrocarbons and some gases that move to the vapor-liquid interface are dissolved in the crude oil to reduce the viscosity of crude oil and increase the production rate of crude oil. The non-condensable gas left in the steam chamber replenishes energy for the expansion of steam chamber so as to reduce the heat loss of steam chamber to the top layer and improve the oil-steam ratio. The crude oil drained into the cracking reaction section is heated by the heating device and the cracking process continues. The crude oil drained into the production section enters the liner and then is lifted to the ground by a downhole pump.

A method for producing heavy oil through solvents generated in situ in the reservoir, comprising the following steps:

Step 1: run a guide string conduit to the tail end of horizontal section in the liner of horizontal producing well at the lower part of reservoir and then run a coiled tube with a heater to the horizontal section from the conduit, where the heater is arranged at the rear end of the horizontal section;

run a thermal packer (temperature resistance of more than 350° C.) between the liner and the conduit annulus in the horizontal section, and separate the annulus of horizontal section into two disconnected independent well sections, where the front section is the production section and the rear section is the cracking reaction section and the coiled tube with a heater is arranged in the cracking reaction section;

Step 2: after turning on the power supply from the ground, input the electric power to the heater at the rear end of horizontal section to heat up the reservoir near the wellbore; monitor the wellbore temperature through thermocouple or optical fiber in the coiled tube, add chemical reaction additives to the cracking reaction section through the conduit after the surface temperature reaches the target temperature of 200-450° C., to enable the high temperature thermal cracking and aquathermolysis reaction of crude oil;

Step 3: The mixture of light hydrocarbon component and non-condensable gas generated from the high temperature cracking of crude oil flows to the steam chamber and then is aggregated and condensed in the vapor-liquid interface. The light hydrocarbon components and some gases are dissolved in the crude oil to reduce the viscosity of crude oil. The diluted crude oil flows to the horizontal producing well along the vapor-liquid interface. The crude oil drained to the cracking reaction section continues the cracking process through the heater, while the crude oil drained to the production section forms a working fluid level on the liner (it is judged that the liquid level of downhole production section is consistent with that by Sub-cool calculation method);

Step 4: after the bottom hole pressure and the temperature of production section reach the preset values, turn on the downhole pump to lift the crude oil and water condensate to the ground for production through the production tubing.

Preferably, a cable, a thermocouple or optical fiber for temperature monitoring and a downhole heater are installed in the coiled tube.

Preferably, the electric heating method is applied for the cracking reaction section, i.e., heat conduction type resistance heating or induction type electromagnetic field or microwave.

Preferably, the surface temperature of the heater is set according to the optimum thermal cracking and aquathermolysis temperature of crude oil, which is related to the properties and cracking process of crude oil and changes within 200-450° C. The surface temperature of heater is monitored through the thermocouple or optical fiber inside the coiled tube, and controlled from the ground by the inputted electric power. The heating process of heater can either be continuous and stable or be intermittent according to the reservoir needs.

Preferably, the chemical reaction additives injected into the conduit can be one or any combination of hydrogen, oxygen, air, water and metal ion catalyst, and the injection can be continuous or intermittent.

Preferably, the type of chemical reaction additives injected and the injection rate are determined by the crude oil component, parameters for cracking reaction kinetics and operating pressure of steam chamber. The operating pressure of the steam chamber is maintained at 2.0-5.0 MPa.

Preferably, the crude oil in the cracking reaction section comes from the crude oil drained from the upper reservoir along the vapor-liquid interface of the steam chamber, crude oil is cracked in the cracking reaction section, light hydrocarbon components and gases flow back into the steam chamber, upgraded oil and condensate are produced through the production section.

Preferably, in the high temperature cracking process of crude oil, while the light hydrocarbon components and non-condensable gases are generated, the heater continuously heats up the reservoir and the condensed water in the near wellbore formation is heated to generate extra steam and replenish energy for the steam chamber.

Preferably, in the original reservoir or the reservoir after steam huff and puff, the operating pressure of cracking reaction section in the producing well is equal to or slightly higher than the current reservoir pressure.

Preferably, the light hydrocarbon components refer to the saturated hydrocarbons ($C_4$-$C_{10}$) with the carbon number less than 10, and the non-condensable gas refers to $CO_2$, $N_2$, $O_2$, $H_2$, CO, $CH_4$, $H_2S$ or their mixture.

Preferably, the crude oil produced by the downhole pump is partially upgraded with reduced specific gravity and viscosity relative to the crude oil in the original reservoir.

Preferably, the fluid temperature of the downhole pump is less than the saturated steam temperature at bottom hole pressure (temperature difference >5.0° C.) to ensure that the fluid does not flash.

Preferably, the chemical reaction additives enter into the annulus of production liner via the guiding conduit inlet of cracking reaction section and then into the formation via the production liner; and the fluid in the production section enters into the production liner and is lifted to the ground via the downhole pump, realizing the whole process of injection and extraction in the same wellbore.

Preferably, the cracking process and the production process of crude oil also can be respectively completed in different horizontal wells.

Compared with the prior art, the present disclosure realizes the self-circulation process of solvent-assisted recovery processes of heavy oil in the reservoir without injecting solvent and steam on the surface, and has the following beneficial effects:

(1) The solvents are generated in situ through the cracking of crude oil in the reservoir to provide displacing medium and energy for the reservoir;

(2) The process of injection and production in the same wellbore is realized by taking a unique segmentation method in the horizontal well below the reservoir;

(3) The high temperature cracking process is controlled and continuous, and the continuous gravity drainage to the producing well ensures the sustainability of in-situ solvent generation;

(4) Only the crude oil drained to the reaction section is heated in the reservoir near the wellbore instead of the whole reservoir. The optimal temperature required by thermal cracking and aquathermolysis can be achieved with less heat energy, and the utilization efficiency of heat energy is high;

(5) A complete self-circulation process of in-situ generation of displacing medium (solvent), oil displacement and production is achieved;

(6) Since most of the greenhouse gases remain underground, the impact of oil recovery process on environmental conditions is reduced.

The present disclosure has a wide range of applications and can be used for:

(1) the reservoir produced after steam injection, to improve the utilization efficiency of remaining heat and recovery of remaining oil reserves;

(2) the conventional heavy oil reservoirs with the buried depth exceeding the economic depth for surface steam injection;

(3) the heavy oil reservoirs after cold production and the thin reservoir, to improve the recovery efficiency.

DETAILED DESCRIPTION OF THE EMBODIMENTS

The present disclosure is further described according to the figures and embodiments to enable the technical personnel in the technical field to understand the present disclosure. However, it should be clear that the present disclosure is not limited to the detailed description of the preferred embodiments, and the ordinary technical personnel in this technical field shall be protected as long as all variations are limited and defined within the spirit and scope of the present disclosure by the attached claims.

Figure 1:
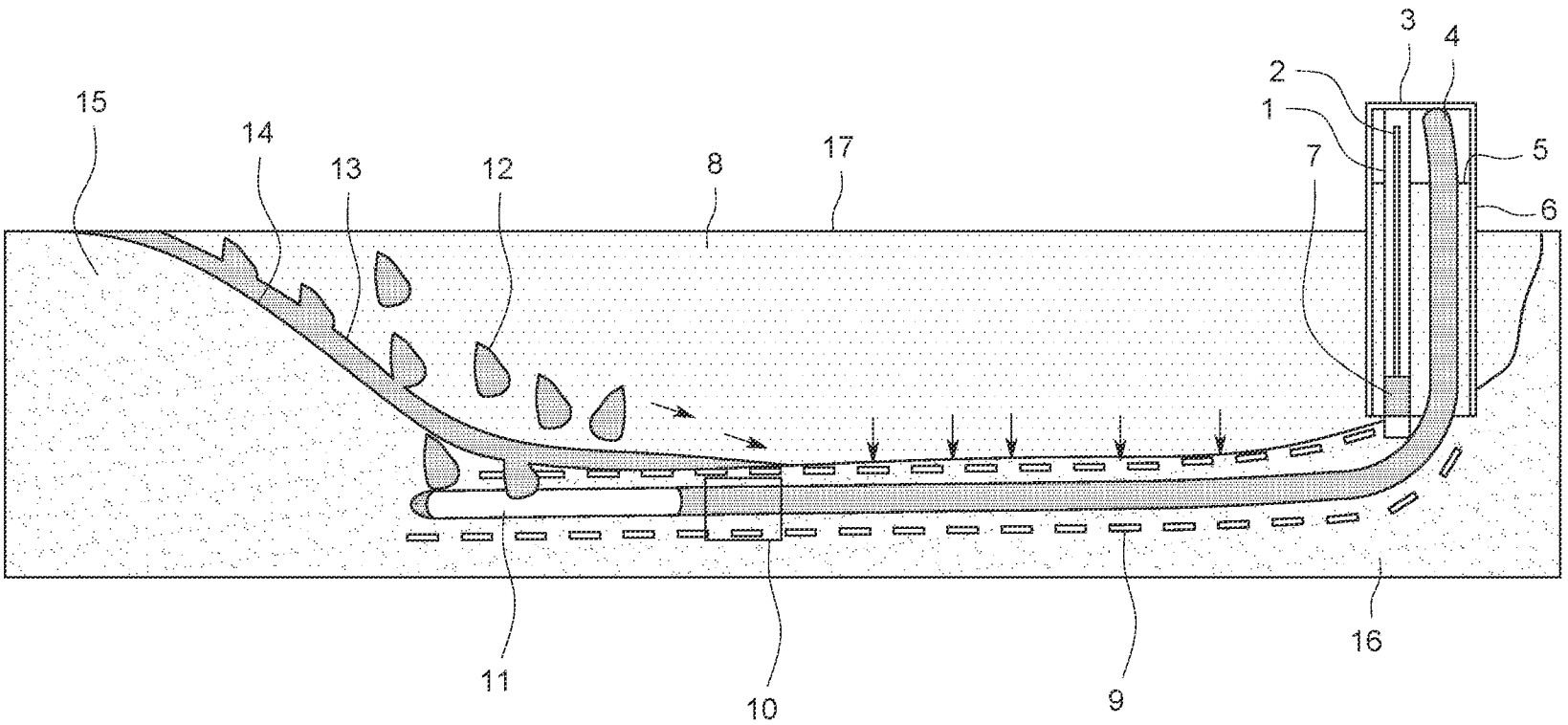
FIG. 1 is a process diagram of a method for producing heavy oil by generating solvents in situ in the reservoir.
Figure 2:
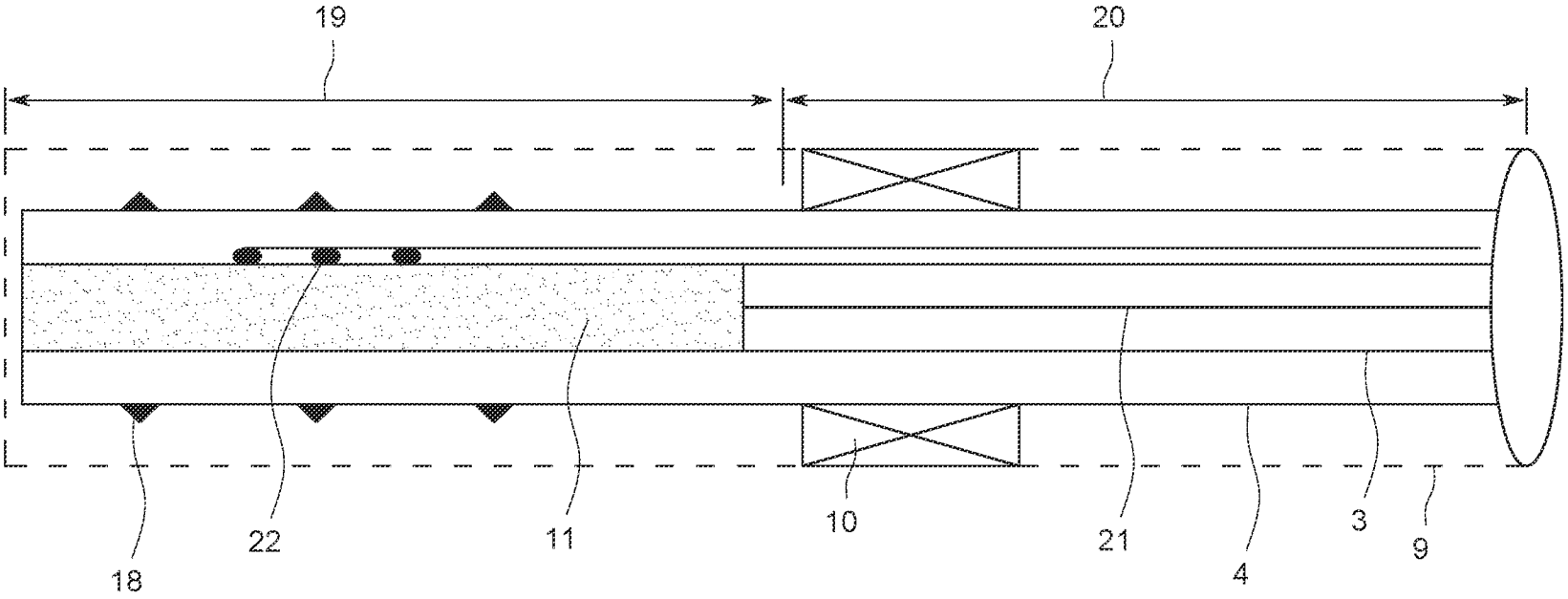
FIG. 2 is a partial enlarged view of pipe string structure and downhole heating device in the horizontal section of the conduit in FIG. 1.

Refer to FIG. 1 and FIG. 2.

First run the conduit (guide string joint) 4 into the production casing 6, reach the tail end of horizontal section via the production liner 9 and then push the coiled tube 3 to the tail end of horizontal section via the conduit; preset the downhole electric heater 11, surface temperature measurement point of heater 22 and cable 21 in the coiled tube, and run the thermal packer 10 according to the designed depth. After installing the downhole facilities in place, seal the wellhead at the corresponding position and then guide the downhole temperature testing signal to the ground. After turning on the power supply, supply power to the downhole electric heater and monitor the surface temperature of heater via the surface temperature measurement point of heater 22. When the temperature reaches the design value, inject chemical additives at the wellhead through the conduit, enter the cracking reaction section 19 through the conduit inlet 18, and realize the thermal cracking and aquathermolysis reaction of crude oil at high temperature, and then the generated light components of crude oil and the mixture of steam and gas, etc. flow to the steam chamber 8, realizing the recovery process of solvent assisted gravity drainage. The fluid drained from the steam chamber flows into the liner in the production section 20 and then flows to the downhole pump 7 and is lifted to the ground via the production tubing 1.

Figure 3:
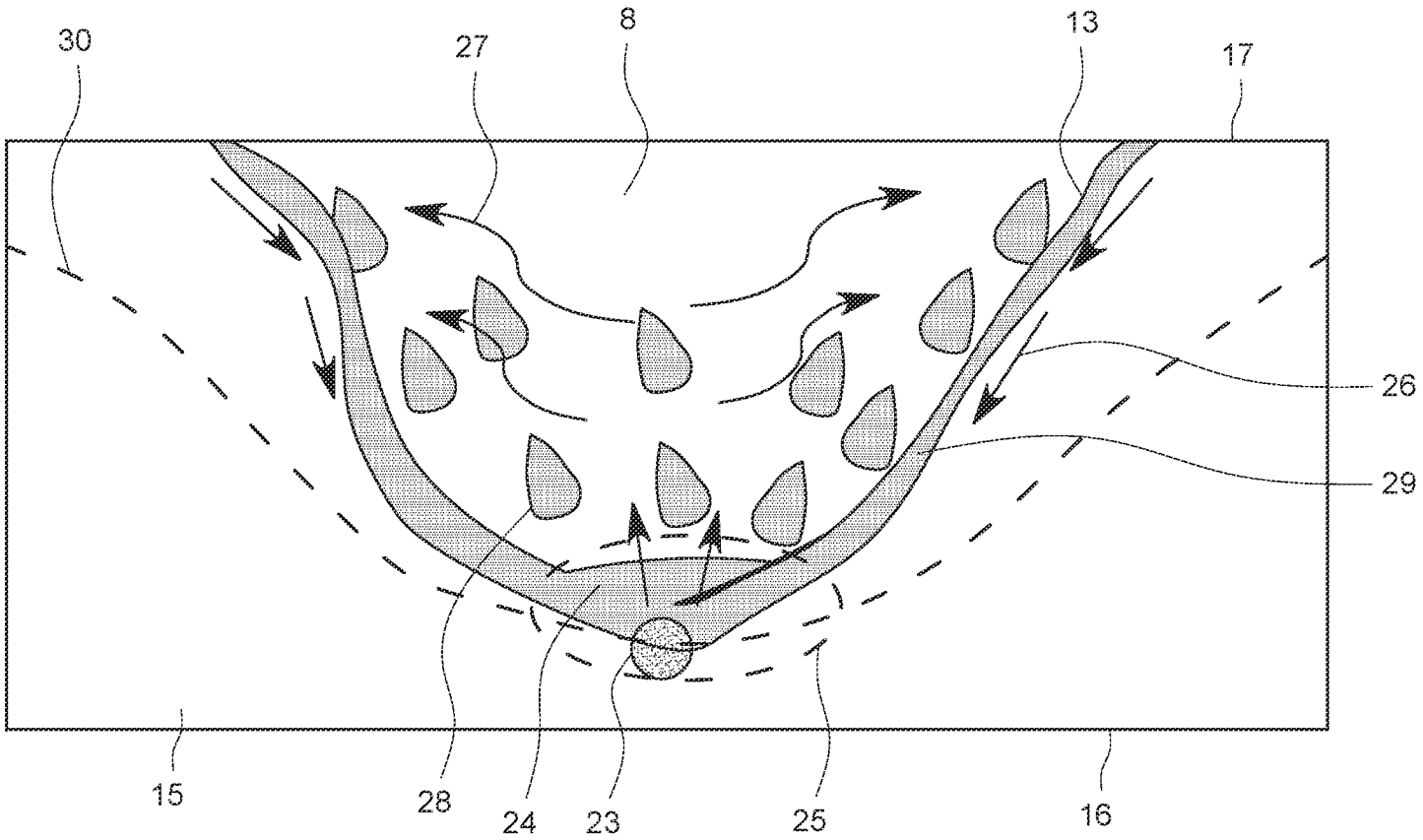
FIG. 3 is a schematic diagram of flow of solvents generated in situ in the steam chamber and the major mechanisms.

The process of producing heavy oil by generating solvents in situ in the middle and later periods of SAGD is shown in FIG. 3, mainly including:

(1) In-Situ Generation of Solvents from Thermal and Aquathermolysis of Crude Oil:

The heater 11 continuously provides heat source for the reservoir above the cracking reaction section 19 to increase the near-wellbore temperature to the target cracking temperature of crude oil. As the fluid accumulated above the horizontal producing well is the mixture of crude oil and condensed water that comes from the steam chamber 8 and is drained along the vapor-liquid interface 13, the mixture generally contains 70-80% water and 20-30% oil. Depending on the pressure of steam chamber 8, under the continuous heating of the heater, some condensed water above the horizontal well of reaction section is vaporized again to generate the thermal cracking and aquathermolysis reaction of crude oil under the high temperature steam conditions. If necessary, catalyst or $H_2$ can be injected into the reaction section via the conduit to create better conditions for chemical reaction.

(2) Maintenance of Steam Chamber Pressure Through the Migration of Solvents into the Steam Chamber:

The mixture of light hydrocarbon components ($C_4$-$C_{10}$), gases and steam generated from high temperature thermal cracking and aquathermolysis flows up to the existing steam chamber to increase the driving energy.

(3) Increase of Crude Oil Production Through the Dissolution of Solvents in the Crude Oil:

The light hydrocarbon and gas components flow to the vapor-liquid interface 13, and the light hydrocarbon component and some gas components (such as $CO_2$ and $CH_4$) are diffused and dissolved in the crude oil in the diluted oil flow layer 29 along the vapor-liquid interface 13 to reduce the viscosity of crude oil in the flow layer and increase the drainage rate and the production of oil well.

(4) Production of Crude Oil;

Most of the crude oil drained to the lower producing well will be produced and the crude oil at the lower part of the horizontal well in the reaction section will be cracked. The process occurring in the reaction section is a continuous self-circulation process. With the development of the production process, the steam chamber will expand outward, and the final oil recovery factor of reservoir can be improved by using the solvents generated in situ in the reservoir under the condition of greatly reducing or even without surface steam injection.

Figure 4:
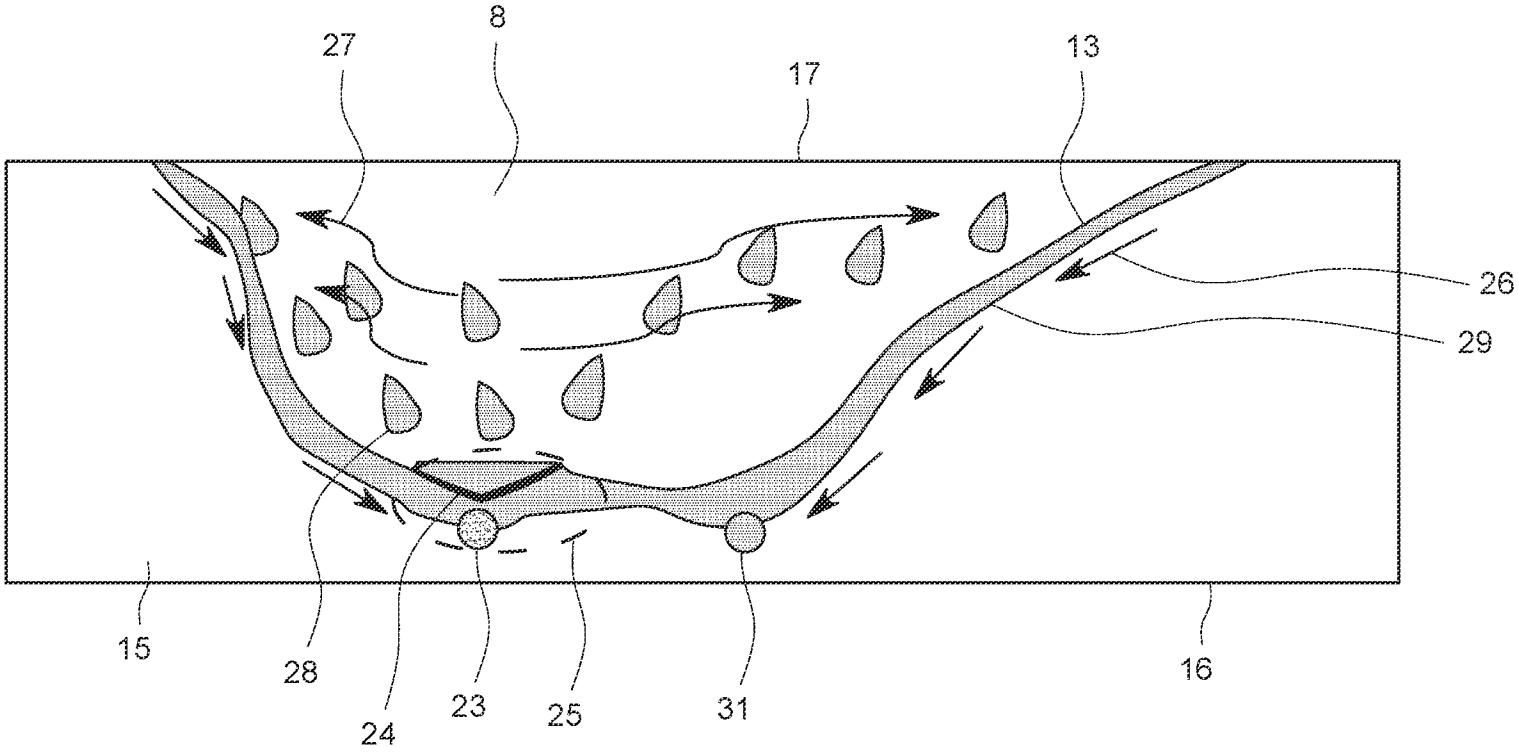
FIG. 4 is a schematic diagram of a method for producing heavy oil by generating solvents in situ in horizontal well pair.
Figure 5:
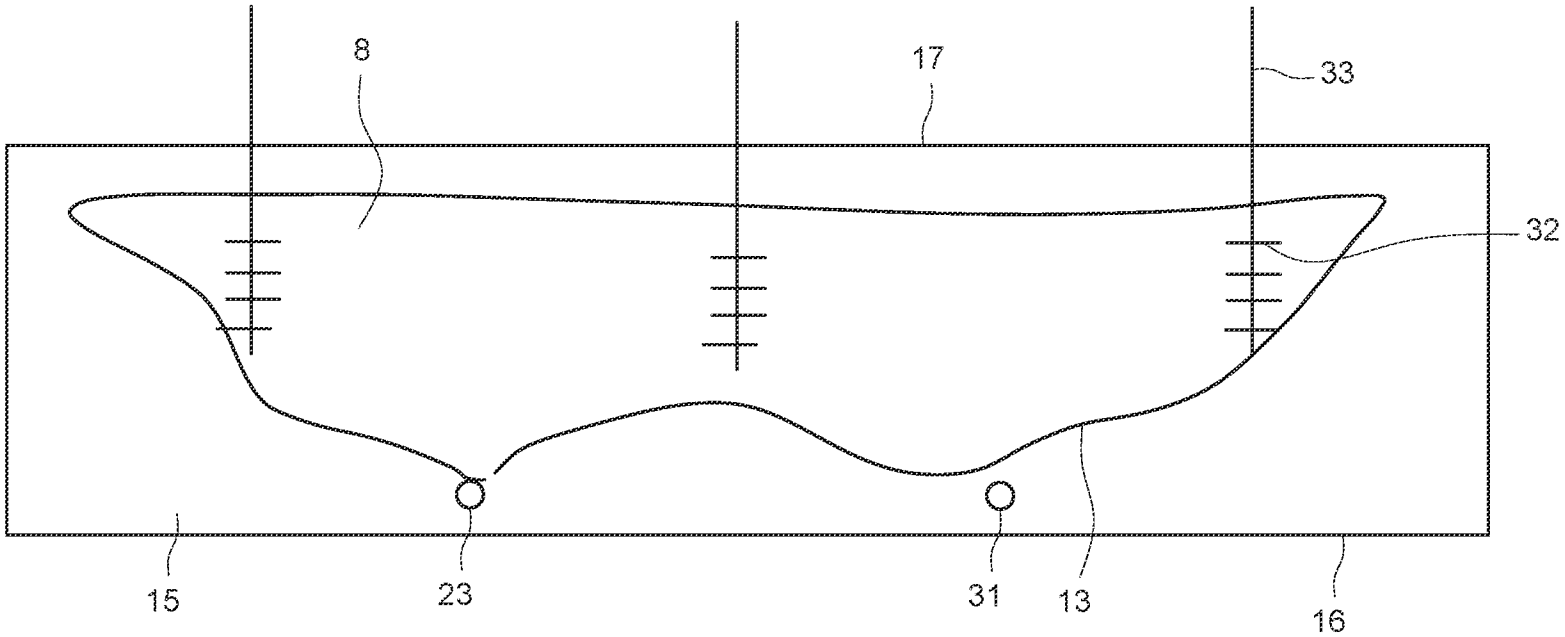
FIG. 5 is a schematic diagram of oil recovery process in Embodiment 1.

Embodiment 1 (as Shown in FIG. 4 and FIG. 5)

A super heavy oil reservoir adopts the SAGD production mode of steam injection in vertical well and oil production in horizontal well. The horizontal section of the horizontal well is 400 m long and the operating pressure of steam chamber is 4.0 MPa. After years of continuous production by steam injection, a large steam chamber volume has been formed in the reservoir with more than 45% of OOIP recovered so far. As SAGD enters the middle and later stages of production, the heat loss from the steam chamber to the surrounding formations increases, the oil-steam ratio decreases, and the oil drainage rate decreases. In order to make full use of the remaining heat in the steam chamber and reduce the steam consumption per unit of produced oil, it is suggested to greatly reduce or stop the surface steam injection. Laboratory and numerical simulation studies show that solvent-assisted SAGD is the best way to improve the production efficiency in the middle and late stages. However, considering the high cost of solvent injection from the ground, it is suggested to implement a method for producing heavy oil by generating solvents in situ in the reservoir.

First of all, all downhole strings and devices required for producing heavy oil by generating solvents in situ in the reservoir are installed in the existing horizontal producing well, including downhole electric heating device (200-300 kW), power supply cable and downhole temperature monitoring. The production liner is separated into a reaction section of 100 m and a production section of 300 m by a thermal packer. The downhole electric heating device is turned on to increase the heating temperature and control the temperature at 200-450° C. Under the present pressure of steam chamber, the condensed water in the near-wellbore area of horizontal well turns into steam and has thermal cracking and aquathermolysis reaction with the crude oil at high temperature in the formation, and the generated light hydrocarbon components and gases flow into the existing steam chamber to provide energy for the existing steam chamber. The light hydrocarbon components and some soluble gases migrated to the vapor-liquid interface are dissolved in the crude oil to reduce the viscosity of the crude oil. The crude oil with reduced viscosity flows to the producing well along the vapor-liquid interface under the action of gravity, and the fluid in the production section is lifted to the ground by a downhole pump. The crude oil drained to the reaction section continues the high temperature thermal cracking and aquathermolysis reaction to continuously generate the solvents in situ. In order to further improve the production effect, the method of injecting catalyst and hydrogen donor into the reaction section could be required. The comparison and evaluation of production performance and the composition changes of produced crude oil before and after catalyst and hydrogen donor injection provides the basis for optimizing the reaction conditions and downhole operation parameters. The concentration of solvents in the steam chamber will also increase over time, and the production rate from solvent assisted drainage will accordingly be enhanced. As the production process proceeds, the steam chamber further expands outward to cover a larger recovery area, improving final recovery factor and achieving the objective of reducing emissions and improving efficiency.

Figure 6:
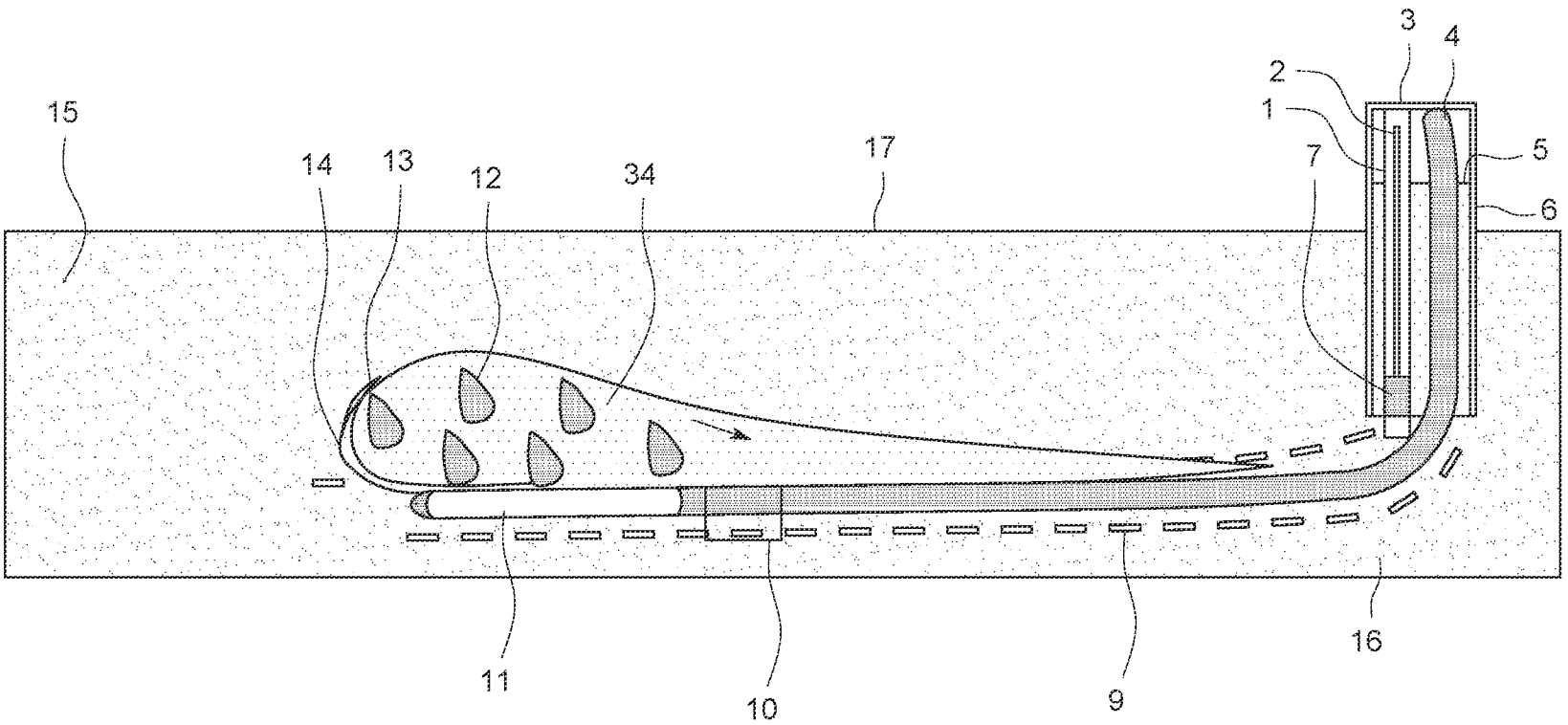
FIG. 6 is a schematic diagram of oil recovery process in Embodiment 2.

Embodiment 2 (as Shown in FIG. 6)

The viscosity of crude oil in this reservoir at the reservoir temperature is 5,000-10,000 mPa·s, the thickness of the pure reservoir is 5-10 m, the depth of the reservoir is 2,000 m, and the initial pressure of the reservoir is 20 MPa. The crude oil in this reservoir has some mobility at the reservoir temperature, but the cold production is low. Due to the limitation of reservoir depth and thickness, the thermal recovery efficiency of surface steam injection is low and thus it is difficult to obtain the economic oil-steam ratio.

A horizontal well where the length of horizontal section is 400-600 m is drilled in the reservoir, which is located at the bottom of the reservoir, and the horizontal section is completed with a liner (as shown in FIG. 6). First of all, all downhole strings and devices required for producing heavy oil by generating solvents in situ in the reservoir are installed in the horizontal producing well, including downhole electric heating device (200-300 kW), power supply cable and downhole temperature monitoring. The production liner is separated into a reaction section of 100 m and a production section of 300 m by a thermal packer. A production tubing is run into the horizontal producing well and then a high temperature screw pump is run via the production tubing. The screw pump is turned on for cold production, and the initial production is expected to be 5-10 t/d. The downhole electric heating device is turned on to increase the surface temperature of heater and control the temperature at 200-450° C. Depending on the movable water content in the formation, 2-10 t/d water may be injected into the formation through the annulus between conduit and coiled tube. Under the continuous heating of electric heating device, the steam generated in the reaction section to achieve aquathermolysis reaction conditions for the crude oil, and the generated light hydrocarbon components are dissolved in the crude oil to reduce the viscosity of crude oil. The gas and some steam generated drive the crude oil with reduced viscosity to the production section and then the crude oil is lifted to the ground by high temperature screw pump. The production rate is expected to increase exponentially due to the partial cracking of the underground crude oil, the increase of light components, the increase of near-wellbore reservoir temperature and the driving energy from in-situ gas generation. Hydrogen or catalyst can be injected into the formation where the reaction section is located. Through the comparison and evaluation of production performance and composition change of produced crude oil, the reaction conditions and downhole operation parameters are optimized.

As the production process proceeds, a steam chamber is formed in the upper reservoir of reaction section. The main components in this steam chamber are the light hydrocarbons, non-condensable gases and a small amount of steam generated from the aquathermolysis of crude oil. The temperature in this steam chamber is lower than the saturated steam temperature under the reservoir pressure. As the production process proceeds, the steam chamber gradually expands to the production section. A single horizontal well is used in the reservoir to generate solvents in situ for producing deep heavy oil so as to improve the production rate and increase the final recovery factor. Generally, for the cold production of heavy oil, the recovery factor is 5-15%. With the solvent assisted gravity drainage method is taken in the present disclosure, the efficiency is high and the final recovery factor is expected to reach more than 40%.

To sum up, the present disclosure provides a method for producing heavy oil by generating solvents in situ in the reservoir and realizes the high temperature thermal cracking and aquathermolysis conditions through downhole heating and injection of chemical additives. The light hydrocarbon components and gases generated in situ provide medium and energy to the formation for displacement of crude oil, so as to increase the quality of produced oil and final recovery factor. As the greenhouse gas generated is reduced from reduced or stopped surface steam injection, in addition to the storage of greenhouse gases in the formation, the production process is cleaner and environment-friendly while the production cost is decreased.

What is claimed is:

1. A method for producing heavy oil through solvents generated in situ in a reservoir, comprising the following steps:

run a guiding conduit to the rear end of a horizontal section in a liner of a horizontal producing well located at the lower part of the reservoir;

run a coiled tube with a pre-installed heater to the horizontal section from a conduit, where the heater is arranged at the terminal end of the horizontal section;

place and expand a thermal packer in an annulus between the liner and the conduit in the horizontal section, to separate the annulus of the horizontal section into two disconnected independent wellbore sections, a production section in the uphole section and a cracking reaction section in the downhole section, wherein the coiled tube with the heater is arranged in the cracking reaction section;

turn on a power supply, and input electric power to the heater to heat up the reservoir near the wellbore; monitor the wellbore temperature with a thermocouple or an optical fiber in the coiled tube, add one or more chemical reaction additives to the cracking reaction section through the conduit after a surface temperature reaches a target temperature of 200-450° C., to enable the high temperature thermal cracking and aquathermolysis reaction of crude oil;

turn on a downhole pump to lift the mixture of crude oil and condensed water to the ground through the production tubing after the bottom hole pressure and the temperature of production section reach preset values.

2. The method for producing heavy oil through solvents generated in situ in the reservoir according to claim 1, wherein a cable, the thermocouple or the optical fiber for temperature monitoring and the downhole heater are installed in the coiled tube.

3. The method for producing heavy oil through solvents generated in situ in the reservoir according to claim 1, wherein the heater is one of a heat conduction type resistance heater, induction type electromagnetic field heater or a microwave heater.

4. The method for producing heavy oil through solvents generated in situ in the reservoir according to claim 1, wherein the chemical reaction additives are selected from hydrogen, oxygen, air, water and metal ion catalyst.

5. The method for producing heavy oil through solvents generated in situ in the reservoir according to claim 4, wherein the chemical reaction additives and their injection rate are determined by the crude oil component, parameters for cracking reaction kinetics and operating pressure of a steam chamber.

6. The method for producing heavy oil through solvents generated in situ in the reservoir according to claim 5, wherein the operating pressure of the steam chamber is maintained at 2.0-5.0 MPa.

7. The method for producing heavy oil through solvents generated in situ in the reservoir according to claim 1, wherein the crude oil in the cracking reaction section comes from crude oil drained from the upper reservoir along the vapor-liquid interface of a steam chamber, the crude oil is cracked in the cracking reaction section, light hydrocarbon components and gases flow back into the steam chamber, and upgraded oil and condensate are produced through the production section.

8. The method for producing heavy oil through solvents generated in situ in the reservoir according to claim 1, wherein in the high temperature thermal cracking process of crude oil generates light hydrocarbon components and non-condensable gases, and the heater continuously heats up the reservoir to generate extra steam and replenish energy for the steam chamber.

9. The method for producing heavy oil through solvents generated in situ in the reservoir according to claim 1, wherein the operating pressure of cracking reaction section in the producing wellbore is equal to or slightly higher than the current reservoir pressure.

10. The method for producing heavy oil through solvents generated in situ in the reservoir according to claim 1, wherein the light hydrocarbon components refer to the saturated hydrocarbons with the carbon number less than 10, and the non-condensable gas refers to $CO_2$, $N_2$, $O_2$, $H_2$, CO, $CH_4$, $H_2S$ or their mixture.

11. The method for producing heavy oil through solvents generated in situ in the reservoir according to claim 1, wherein the fluid temperature entering to the downhole pump is less than the saturated steam temperature at bottom hole pressure to ensure that the fluid does not flash.

12. The method for producing heavy oil through solvents generated in situ in the reservoir according to claim 1, wherein the chemical reaction additives enter into the annulus of the production liner via the guiding conduit inlet of the cracking reaction section and then enter into the formation via the production liner; and the fluid in the production section enters into the production liner and is lifted to the ground via the downhole pump, realizing the whole process of injection and extraction in the same wellbore.

* * * * *